US007131293B2

(12) United States Patent
Filipiak et al.

(10) Patent No.: US 7,131,293 B2
(45) Date of Patent: Nov. 7, 2006

(54) DRYER INTEGRATED CONDENSER OF A REFRIGERATING SYSTEM AND A METHOD OF ASSEMBLING THE SAME

(75) Inventors: Marek Filipiak, Ostrow Wlkp (PL); Pawel Borowczyk, Ostrow Wlkp (PL); Roman Misiak, Ostrow Wlkp (PL)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/082,303

(22) Filed: Mar. 17, 2005

(65) Prior Publication Data

US 2005/0223736 A1 Oct. 13, 2005

(30) Foreign Application Priority Data

Apr. 8, 2004 (EP) ..... 04460007

(51) Int. Cl.
*F25B 39/04* (2006.01)

(52) U.S. Cl. ..... 62/509

(58) Field of Classification Search ..... 62/509
See application file for complete search history.

(56) References Cited

U.S. PATENT DOCUMENTS 5,884,503 A * 3/1999 Inaba ..... 62/509
5,946,940 A * 9/1999 Inoue ..... 62/509
6,052,899 A * 4/2000 Inaba ..... 29/890.043
6,209,348 B1 * 4/2001 Shinmura et al. ..... 62/509
6,334,333 B1 * 1/2002 Shinhama ..... 62/509
6,623,693 B1 9/2003 Sircar ..... 420/535
2003/0173069 A1 * 9/2003 Nitta et al. ..... 165/178
2004/0007012 A1 * 1/2004 Lee et al. ..... 62/474

FOREIGN PATENT DOCUMENTS

EP 0936423 8/1999
EP 936423 A2 * 8/1999
JP 091593172 6/1997
JP 10002692 1/1998
JP 2000257992 9/2000

OTHER PUBLICATIONS

Encarta World English Dictionary [ North American Edition ]; 2005; http://encarta.msn.com.*

* cited by examiner

*Primary Examiner*—Cheryl J. Tyler
*Assistant Examiner*—B. Clayton McCraw
(74) *Attorney, Agent, or Firm*—Patrick M. Griffin

(57) ABSTRACT

In a refrigerating system, a condenser (1) includes a cooling core (2) having parallel tubes and cooling fins, two headers (3) connected to the ends of each tube and a cylindrical dryer tank (4) connected to one of the headers (3) by connectors (5). Each connector (5) has a cylindrical side surface, and cylindrical butting faces corresponding to the header and the dryer tank respective side surfaces. During preliminary assembling of the condenser, cylindrical projections of connectors (5) are pushed into corresponding orifices in the header (3) and the dryer tank (4) side surfaces, and the entire unit is placed in a furnace, where the one-shot brazing process is carried out.

4 Claims, 3 Drawing Sheets

DRYER INTEGRATED CONDENSER OF A REFRIGERATING SYSTEM AND A METHOD OF ASSEMBLING THE SAME

The invention relates to a dryer integrated condenser of a refrigerating system, in particular a vehicle air condition system, comprising a cooling core consisting of plurality of parallel tubes and cooling fins, two headers fluidly connected with reciprocal ends of each tube and a cylindrical dryer tank fluidly connected with one header by means of at least two connectors which are smaller in thermal capacity than the header and the dryer tank. The invention further relates to a method of assembling of such a condenser.

In vehicle air condition systems, condenser and dryer tank commonly form two separate units connected with each other by means of pipes, which increase the space necessary for their installation and give rise to other difficulties such as necessity to mount these units separately to a vehicle chassis and to independently secure them against vibrations that may lead to leakage of connections between the condenser and a dryer tank.

U.S. Pat. Nos. 5,884,503 and 6,052,899 disclose a condenser fluidly connected with a cylindrical liquid tank by means of at least two coupling brackets, smaller in thermal capacity than condenser header and the liquid tank, being secured to an outer cylindrical surface of the header and an outer cylindrical surface of the liquid tank by means of brazing. Brackets comprise also an additional passageway pipe fixedly inserted into a bracket for flow of a coolant between the header and the liquid tank.

The aim of the present invention is to provide a condenser connected with a dryer tank by means of connectors having simple one-part and economic construction, which allows bonding a condenser header and a dryer tank easily, by means of one-shot brazing operation, ensures proper leakproofness of connection, durability for mechanical vibrations, as well as minimises the installation space.

In accordance with the first aspect of the present invention there is provided a condenser that conforms to the aforementioned requirements in which each connector has a form of uniform shape having a cylindrical side surface, cylindrical butting face corresponding to the header side surface and having a substantially cylindrical projection, cylindrical butting face corresponding to the dryer tank side surface and having a substantially cylindrical projection, wherein cylindrical projections are positioned in the header and the dryer tank orifices and the connector is bonded to the header and the dryer tank by means of brazing agent that fills the space between the connector butting faces and respective side surfaces of the header and the dryer tank.

Such shapes of joining surfaces ensure that a large contact surface joint is obtained thus providing mechanical strength and resistance to mechanical vibrations. The connector has a simple, single-component design, can be easily made of aluminium alloy either by forward or backward extrusion, stamping or casting, and its cylindrical form provides minimum weight to contact surface ratio. Cylindrical butting faces and cylindrical projections of the connector make it also possible to pre-assemble the header and the dryer tank together in unambiguous and error-free manner, which enables further one-shot brazing.

Connector diameter is preferably greater than a distance between the faces of cylindrical projections.

Such a construction allows minimizing the installation space by providing very close distance between the header and the dryer tank, as well as providing structural reinforcement of condenser structure.

Preferably according to the invention the connector has a straight through port crossing cylindrical projections. Such a port allows a flow of coolant between the header and the dryer tank.

Cylindrical side surface of the connector may be provided with at least one positioning recess, which additionally facilitates accurate positioning of the connector prior to brazing the condenser.

Furthermore cylindrical projections of the condenser may have on their side surface notches, whose outer diameter is greater than the diameter of corresponding orifices in the header and the dryer tank. Such notches allow punching of the orifice edges where the connector communicates with the header and the dryer tank, respectively. Consequently, a serrated contact surface between the orifice edges and the cylindrical projections of the connector is obtained.

In accordance with the second aspect of the present invention there is provided a method of assembling a dryer integrated condenser of a refrigerating system, in particular of a vehicle air condition system, said condenser comprising a header fluidly connected and in parallel to a cylindrical dryer tank by means of not less than two connectors. According to the present invention the assembling method consists of the following steps:

(i) manufacturing connectors being shaped as uniform components having a cylindrical side surface and cylindrical butting faces corresponding to the header and the dryer tank respective side surfaces, said butting faces having substantially cylindrical projections;

(ii) making orifices in both the header and the dryer tank side surfaces, said orifices having diameters corresponding to diameters of respective cylindrical projections of the connectors;

(iii) preliminary assembling the condenser by pushing cylindrical projections of the connectors into corresponding orifices in the header and the dryer tank side surfaces and pressing the header and the dryer tank to each other;

(iv) one-shot brazing of the condenser components by means of brazing agent placed between the connector butting faces and corresponding side surfaces of the header and the dryer tank.

As the thermal capacity of the connector is lower than the header and the dryer tank, during the brazing process the connector heaths up at higher rates than the adjacent components, and owing to capillary brazing effect, brazing agent is sucked into the gaps below the butting faces of the connector. Cylindrical shape of connector leads to forming elliptical butting faces, reaching the beneficiary temperature distribution across the joint and consequential uniform spreading of brazing agent on the entire butting faces of the connector is possible. Consequently, the process results in joining the connectors with both the header and the dryer tank by means of the brazing agent interlayer.

A method according to the invention preferably comprises a step of forming a port passing through cylindrical projections of at least one connector.

A method according to the invention preferably comprises an additional step of placing the brazing agent in a form of rings between connector butting faces and corresponding side surfaces of the header and the dryer tank. That step is obligatory if the header or more likely the dryer tank are not covered by a clad layer of braze.

The invention is presented below by way of examples of preferred embodiments with reference to figures of the drawings in which.

Figure 4:
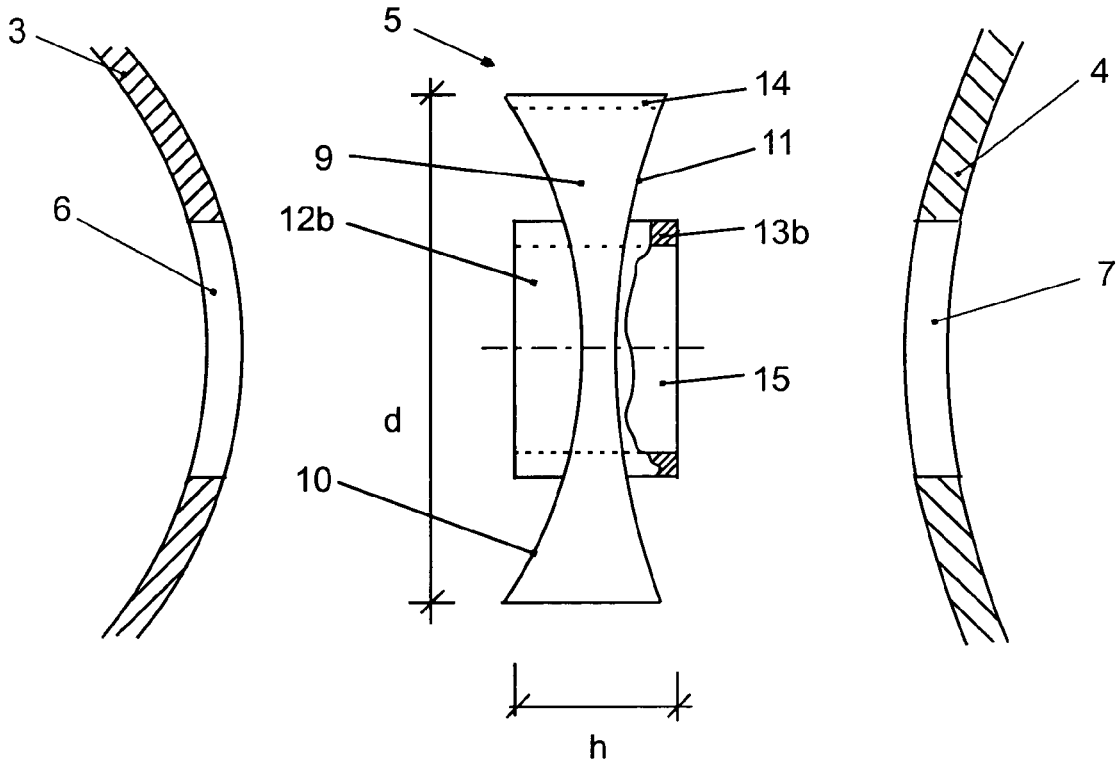
Figure 5:
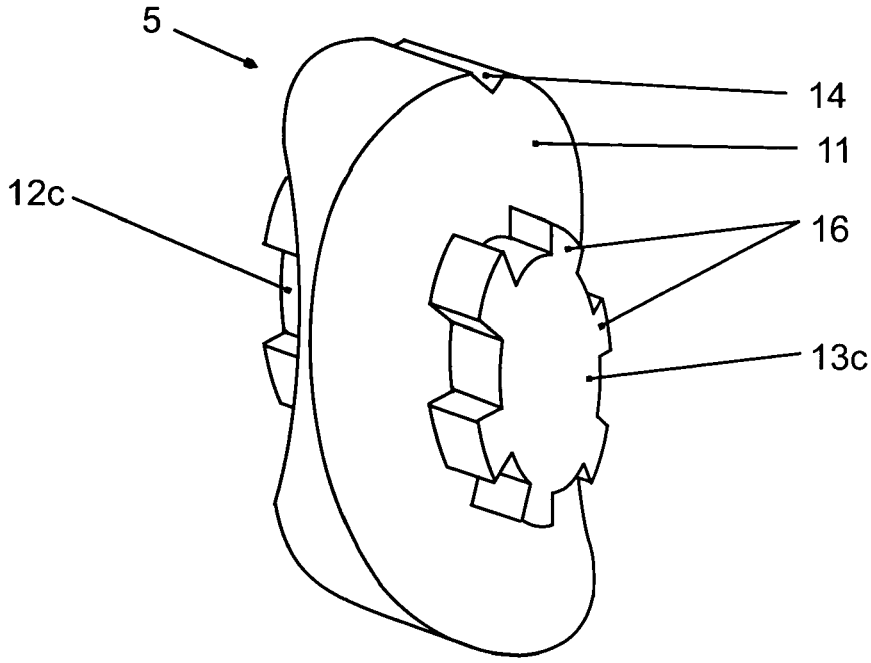
Figure 6:
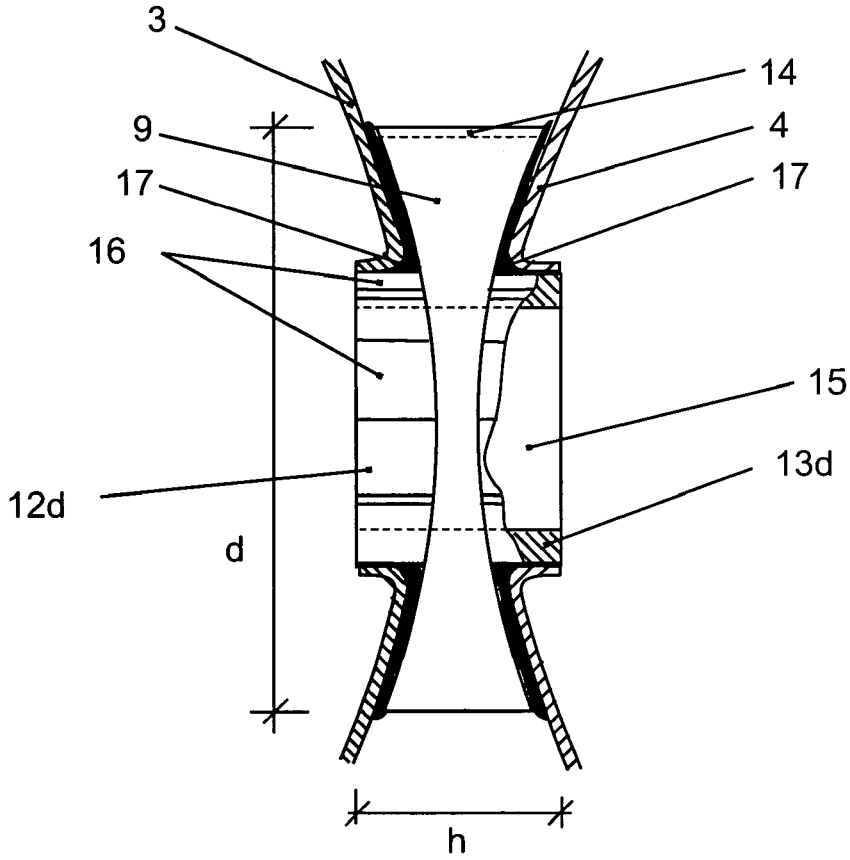

FIG. 4 is a top cross-section of the portions of the header and the dryer tank side surfaces with a connector according to the second embodiment of the present invention disposed between said side surfaces, FIG. 5 is an axonometric view of the connector according to the third embodiment of the invention; and FIG. 6 is a top cross-section of the portions of the header and the dryer tank side surfaces with a connector according to the fourth embodiment of the present invention disposed between the said side surfaces.

Figure 1:
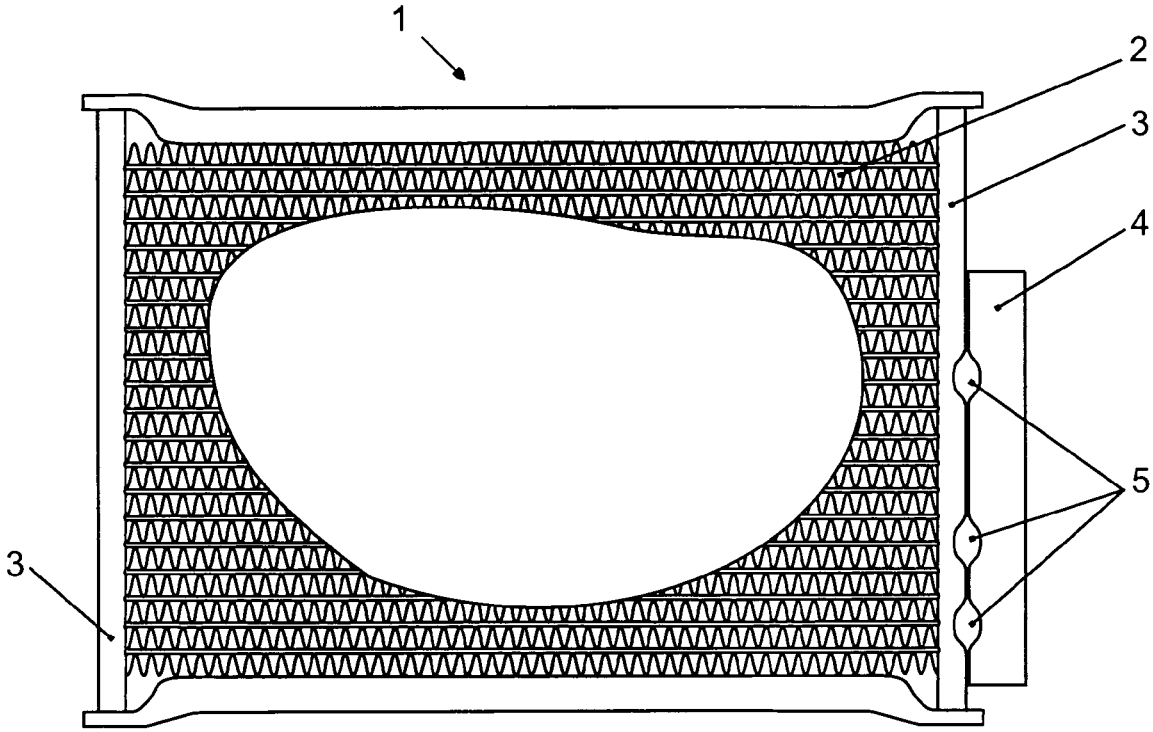
FIG. 1 is a side view of a condenser integrated with a dryer tank according to the invention after bonding the dryer tank with condenser header by means of three connectors and by brazing.

The condenser 1 shown in FIG. 1 is a part of a refrigerating cycle of a vehicle air condition system, not shown in details on drawings, and is connected between compressor and expansion valve in a manner known to a person skilled in the art. Condenser is made of aluminium alloy and comprises a cooling core 2 consisting of plurality of parallel tubes and cooling fins, and two cylindrical headers 3 fluidly connected with reciprocal ends of each tube. The cylindrical dryer 4 is fluidly connected with the header by means of three connectors 5, lower two of which enable flow of coolant between the condenser header 3 and the dryer tank 4.

Figure 2:
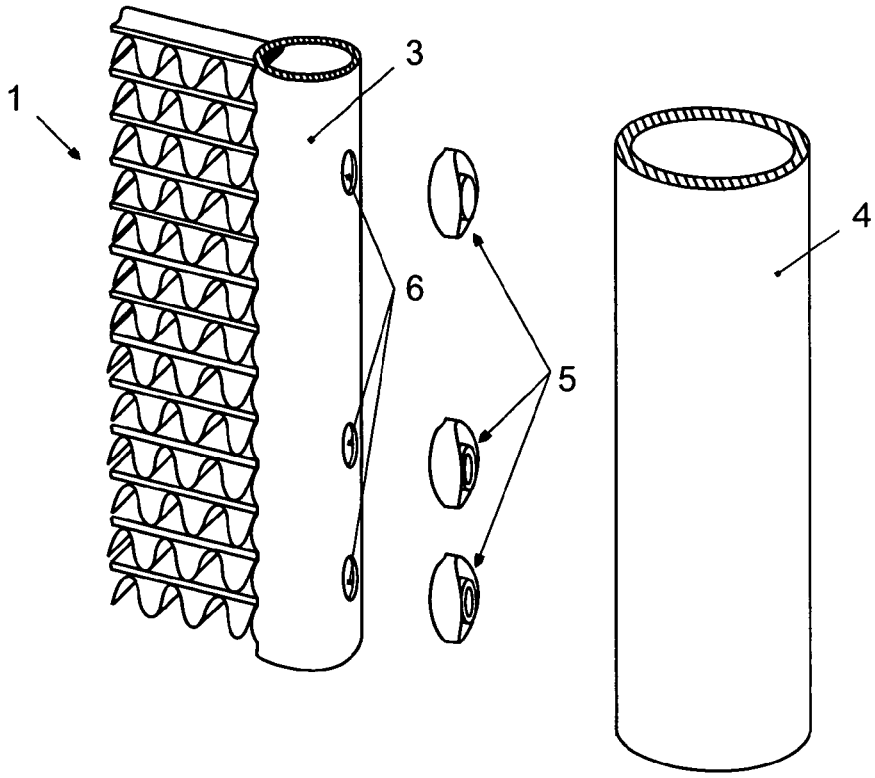
FIG. 2 is a top axonometric view of part of the condenser shown in FIG. 1 during preliminary assembling.

As shown in FIG. 2, prior preliminary assembling of the dryer integrated condenser 1, header 3 and the dryer tank 4 side surfaces, both covered with a clad layer, were provided with orifices 6 and 7. Orifices serve as mounting points for cylindrical projections of connectors 5 (shown in details in FIG. 3 to FIG. 6). During preliminary assembling cylindrical projections of connectors 5 are pushed into corresponding orifices, and the header and the dryer tank are pressed to each other in unambiguous and error-free manner.

In subsequent step, the entire unit is placed in a furnace, where the one-shot brazing process is carried out.

Figure 3:
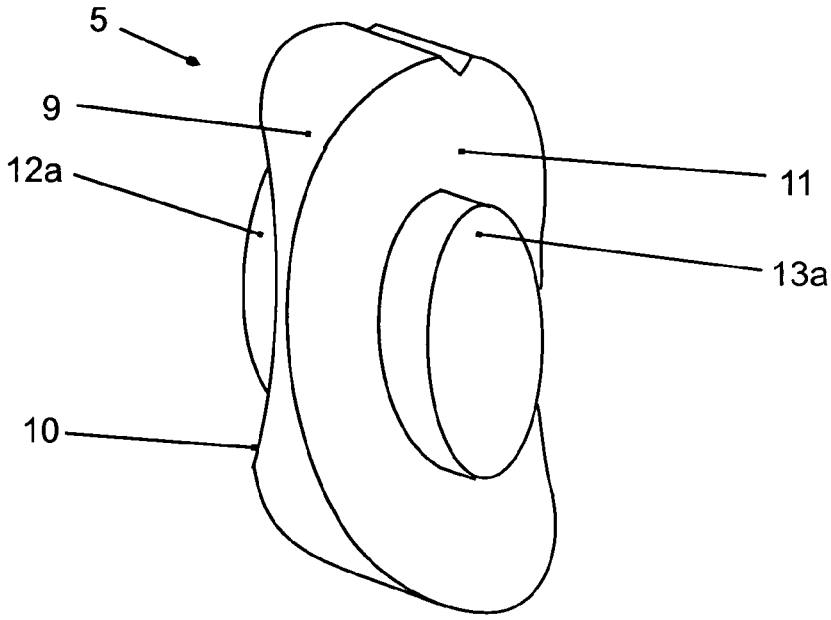
FIG. 3 is an axonometric view of the connector according to the first embodiment of the invention.

FIG. 3 shows an axonometric view of the connector according to the first embodiment of the invention. The connector 5 has a cylindrical side surface 9 and two cylindrical butting faces 10 and 11 having cylindrical projections 12*a* and 13*a*. Curvatures of said butting faces correspond to curvatures of respective side surfaces of the header 3 and the dryer tank 4.

FIG. 4 shows a cross-section of the portions of both the header 3 and the dryer tank 4 and the connector 5 according to the second embodiment of the present invention prior preliminary assembling. This embodiment differs from the one shown in FIG. 1 by presence of a straight through port 15 that enables flow of a coolant. Said port crosses the cylindrical projections 12*b* and 13*b*. As shown, the connector 5 diameter "d" is greater than the distance "h" between faces of cylindrical projections.

FIG. 5 shows an axonometric view of the connector according to the third embodiment of the invention. In this case, the cylindrical projections 12*c* and 12*c* have notches 16 in the form of serration. Furthermore the side surface of the connector is provided with a fixing recess 14 that facilitates preliminary positioning of the connector prior to brazing.

The connector, shown in cross-section in FIG. 6 is a variation of the above embodiment. Likewise to the connector from the FIG. 4, it has a straight through port 15. Owing to the fact that the external diameter of the notches 16 is greater than the diameters of orifices in respective side walls of the header 3 and the dryer tank 4, while pressing the said header 3 and the dryer tank 4 together, the notches punches the edges of the orifices 6 and 7 and simultaneously bends them inwards thus fixing the connector onside respective orifices of the header and the dryer tank. As shown the brazing agent interlayer 17 fills the space between the connector butting faces and respective side surfaces of the header and the dryer tank.

The invention claimed is:

1. A dryer integrated condenser of a refrigerating system comprising a cooling core consisting of a plurality of parallel tubes and cooling fins, a header fluidly connected with an end of each tube and comprising a header side surface having a header orifice, and a cylindrical dryer tank comprising a dryer tank side surface having a dryer tank orifice, and a connector connecting the header and the dryer tank and having a thermal capacity that is smaller than the header and the dryer tank, said connector being formed of an integral metal body and comprising a cylindrical side surface, cylindrical butting face corresponding to the header side surface and having a substantially cylindrical projection received in the header orifice, cylindrical butting face corresponding to the dryer tank side surface and having a substantially cylindrical projection received in the dryer tank orifice, wherein the connector is bonded to the header and the dryer tank by a brazing agent;

wherein the connector is characterised in that the cylindrical side surface of the connector has at least one positioning recess.

2. A condenser as claimed in claim 1, characterised in that the connector diameter (d) is greater than a distance (h) between ends of the cylindrical projections.

3. A condenser as claimed in claim 1, characterised in that the connector has a straight port extending through the cylindrical projections.

4. A dryer integrated condenser of a refrigerating system comprising a cooling core consisting of a plurality of parallel tubes and cooling fins, a header fluidly connected with an end of each tube and comprising a header side surface having a header orifice, and a cylindrical dryer tank comprising a dryer tank side surface having a dryer tank orifice, and a connector connecting the header and the dryer tank and having a thermal capacity that is smaller than the header and the dryer tank, said connector being formed of an integral metal body and comprising a cylindrical side surface, cylindrical butting face corresponding to the header side surface and having a substantially cylindrical projection received in the header orifice, cylindrical butting face corresponding to the dryer tank side surface and having a substantially cylindrical projection received in the dryer tank orifice, wherein the connector is bonded to the header and the dryer tank by a brazing agent;

wherein the connector is characterised in that at least one of the cylindrical projections comprises notches to provide a serrated contact surface when received in the corresponding orifice of the header or dryer tank.

* * * * *